US005237705A

United States Patent [19]

Collins

[11] Patent Number: 5,237,705

[45] Date of Patent: Aug. 24, 1993

[54] METHOD OF MAKING A GARMENT HAVING A SEAMLESS BODY PORTION

[75] Inventor: Ellis Collins, New Albany, Miss.

[73] Assignee: Obion Denton Co., New Albany, Miss.

[21] Appl. No.: 868,358

[22] Filed: Apr. 14, 1992

[51] Int. Cl.[5] ..... A41D 27/00; A41D 11/00

[52] U.S. Cl. ..... 2/243.1; 2/75; 2/80; 2/83; 112/265.2

[58] Field of Search ..... 2/243 B, 243 R, 75, 2/80, 69, 69.5, 83, 111, 262.2; 112/63, 265.2

[56] References Cited

U.S. PATENT DOCUMENTS

| | | | |
|---|---|---|---|
| 1,125,467 | 1/1915 | Cannon | 2/84 |
| 1,888,676 | 11/1932 | Jennings | 2/227 |
| 1,982,579 | 11/1934 | Earnshaw | 2/83 |
| 2,615,165 | 10/1952 | Steedman . | |
| 2,663,873 | 12/1953 | Stern . | |
| 2,697,837 | 12/1954 | Goldman . | |
| 3,166,762 | 1/1965 | Winkworth | 2/80 |
| 3,435,461 | 4/1969 | Artzt | 2/243 R |
| 3,841,247 | 10/1974 | Off et al. | 112/121.27 |
| 4,149,274 | 4/1979 | Garrou et al. | 2/83 X |
| 4,257,127 | 3/1981 | Kaupin et al. . | |
| 4,411,211 | 10/1983 | Heimberger | 112/235 X |
| 4,497,270 | 2/1985 | Boser . | |
| 4,633,792 | 1/1987 | Yoshioka . | |
| 4,834,010 | 5/1989 | Choi et al. | 112/63 |
| 4,843,648 | 7/1989 | Goldberg . | |
| 4,852,272 | 8/1989 | Chilewich et al. | 2/83 |
| 4,853,977 | 8/1989 | Foreman . | |
| 4,956,879 | 9/1990 | Adams . | |
| 5,058,208 | 10/1991 | Adams | 2/243 R |

*Primary Examiner*—Clifford D. Crowder
*Assistant Examiner*—Jeanette E. Chapman
*Attorney, Agent, or Firm*—Lowe, Price, LeBlanc & Becker

[57] ABSTRACT

A sewing method is provided for the production of garments which include a one-piece seamless body portion, wherein the finished garment will have no seams in the back or the sides. The key step in this method involves positioning a cut fabric element corresponding to the central body portion of the garment, in a face up manner, directly beneath an extension of a base of a sewing machine. Ample space is provided between this extended base of the sewing machine and a substantially horizontal surface on which the fabric element is thus placed. A supply of sliding fastener tape is provided immediately in front of a pair of cooperating needles of the sewing machine. The operator lifts two side edges of the workpiece and feeds them through a conventional edge folding element so that the side edges are folded over as they approach the needles. A length of the sliding fastener tape is laid over the folded edges of the workpiece and fed simultaneously therewith, under the operator's scrutiny and control, to the two needles. The sliding fastener element is thus sewn to the folded over edges of the one-piece, seamless, central body portion of the garment. Leg portions of the central body portion may then be completed in conventional manner, and additional elements such as a collar, sleeves, ankle portions, toe-caps and/or booties or the like then can be readily assembled to the central body portion to complete the garment.

10 Claims, 10 Drawing Sheets

METHOD OF MAKING A GARMENT HAVING A SEAMLESS BODY PORTION

FIELD OF THE INVENTION

This invention relates to a method for forming a garment having a seamless body portion, and more particularly to a method for conveniently hemming elongate edge portions of a seamless body portion of the garment while simultaneously sewing thereto an elongate fastener element to form a readily openable closure for the finished garment.

BACKGROUND OF THE INVENTION

In the early 1860's, Whitley Denton, a Mill Superintendent at a company called The Michigan Central Woolen Company, in Centerville, Mich., designed an improved form of the one-piece union suit by constructing a pair of booties and attaching them to the ankles of the union suit to create a garment for young children. At that time, rubber buttons and button holes were employed to provide the necessary closure for the garment. Various forms of the garment, e.g., as sleepers, playsuits and the like, have been sold over the decades all over the world. Subsequent developments of the sliding fastener commonly known as a "zipper" have provided improvement to the basic idea. More recently, the general availability of pressure-responsive fastening means, commonly known as "Velcro" (TM), have provided other alternatives.

A highly desirable feature of such a garment, which is often worn next to the skin by a user, is the avoidance of unnecessary seams in the body portion of the garment, especially at the sides and the back. For babies and younger children who may be picked up by adults by being grasped at their sides, and who may often lie for prolong periods on their backs, seams at the sides and the back are particulary unwelcome. The provision of a one-piece body portion for such a garment is, therefore, almost a necessity.

If the garment is to be employed as an item of thermal underwear, it is most likely to be formed of knitted fabric, which, typically, does not have a pronounced directional orientation in terms of strength and/or stiffness. On the other hand, if the garment is intended to be a warm playsuit for a child, the fabric may be of the woven type, i.e., one in which the warp end and the woof threads intersect othogonally and inherently generate preferred directions of stiffness. The handling of patterned elements of knitted or woven fabrics may therefore have to be different, depending on the manner in which attachment of the closure element is to be effected. If the closure element is one which includes a sliding fastener, e.g., the conventional "zipper", it will be provided most conveniently in the form of an elongate tape or ribbon-like element stored on a reel. Small relatively hard engaging elements of the zipper structure are themselves connected to each of two elongate parallel cloth strips which, while flexible, typically do not have the stretch which knitted fabrics inherently possess. Consequently, the attachment of such a closure element to knitted fabric requires careful handling, to avoid disparate tensions on the knitted fabric and the closure element. Woven fabrics, however, may be somewhat easier to handle, depending on the orientation of the structural threads of the woven fabric.

Numerous machines, and methods for using the same, are available for attaching elongate, sliding-fastener type, closure elements to both knitted and woven fabrics. For convenience, the fabric edges are conventionally passed through folder elements which fold the extreme edge portions of the fabric so that the elongate fastener element is sewn thereto in a single pass under two cooperating needles which provide two parallel lines of stitching to the hemmed fabric as the hemmed edges are attached to the closure element. This is relatively easy when two separate pieces of fabric are to be attached to the same elongate closure element. Examples of apparatus and methods for such work include those disclosed in U.S. Pat. No. 4,623,792 to Yoshioka, titled "Apparatus for Sewing Slide Fasteners to Pairs of Fabric Pieces".

The handling problem is somewhat different if a one-piece fabric element is to have two of its single edges connected to an elongate fastening element like a zipper to create an openable closure thereby. U.S. Pat. No. 4,956,879 to Adams, titled "Garment Having Seamless Body" discloses a method for sewing a garment having a seamless body portion. As best seen in FIG. 1 of this application (a reproduction of FIG. 6 of Adams), a one-piece body component 30 is placed "face down" on table 40 of sewing machine 42 behind, i.e., downstream of, a pair of needles 44. The upper end of the body portion of fabric piece 30 faces the operator initially. A ring-shaped needle guard 46 surrounds needles 44 to prevent the fabric of piece 30 from tangling with the needles during a step in which the fabric is pulled toward the operator, turned and fed through a folder element 48 disposed upstream of the needles. Folder element 48 turns the two edges 30*a* and 30*b* of the fabric piece 30 to form respective hems immediately prior to stitching by the needles. As best seen in FIG. 2 of this application (a reproduction of FIG. 7 of Adams), a length of slide fastener tape 56 is conveniently dispensed from a roll 58 thereof through a guide and tension attachment 60, to a point downstream with respect to folder element 48 but upstream of needles 44. Thus, when the folded fabric hems are stitched by the needles 44, the slide fastener tape 56 is simultaneously stitched to the hems, thereby forming a closure 66.

In the method of Adams, considerable and careful manipulation of the fabric piece 30 is required. Specifically, the upper ends of side edges 30*a* and 30*b* are forcibly pulled toward the operator, around needle guard 46 and folder 48, then rotated to be headed away from the operator and toward folder 48, then fed through the folder 48 to create the folds at the edges, and then fed to the needles with the slide fastener tape 56. The direction of such manipulation is indicated generally by the broken lines in FIG. 1. According to this specification of the Adams patent, the needle guard is an important feature of the equipment that is used with the claimed method because it prevents the middle part of body portion 30 from tangling with needles 44 while side edges 30*a* and 30*b* are forcibly drawn upstream around the needles to position them for feeding to the needles.

As will be appreciated immediately by persons of skilled in the art, the required forcible turning and feeding of fabric piece 30 will likely be easier with knitted fabric than with woven fabric. However, if fitted fabric is thus pulled and stretched along the edges, particular care must be taken in feeding it through folder element 48 and in correspondence with fastener tape 56 to avoid crinkling, bunching, or buckling of the folder fabric with respect to the fastener tape. If fabric piece 30 is made of a conventional woven fabric, since such fabric at the time of handling will be new and relatively stiff, the operator will have a somewhat different set of handling problems to cope with.

German Patent No. 1,918,719 (now expired), titled "Bed Linen Production With Simultaneously Sewn Slide Fasteners", discloses apparatus and a method for attaching elongate slide fasteners to elements of bed linen, e.g., pillow-cases, bedspreads and the like. The elongate slide fastener tape is fed underneath folded parallel edges of a one-piece length of fabric as folded edges of the fabric are fed thereover to parallel cooperating needles. In the most relevant form of the disclosed apparatus and method, per FIG. 3 of this application (a reproduction of FIG. 5 of the German reference), a long length of fabric, probably several tens of meters in length and initially stored on a bolt 5, is fed in a forward direction underneath an arm of sewing machine 1 and the elongate outer edges of the fabric are brought together and passed through folder elements 9,9. The folded edges of the fabric are thus fed in correspondence with an elongate sliding fastener tape 7 fed therebelow, so that the fastener tape and the folded edges of the fabric together pass under sewing machine head 3 and needles 12, 12 at a matching speed. It is clear from FIG. 3 that this method has merit where very long lengths of fabric are to be processed with a correspondingly long length of fastener element in an automatic manner. Persons skilled in the art will appreciate from FIG. 3 that if the fabric has a printed or patterned face, that face is fed to the sewing machine in a "face down" manner. Furthermore, the elongate fastening element tape is fed underneath the folded edges of the fabric. Since it is very important that the sewn edges of the fastener element tape be correctly sewn to the folded over edges, this method may not be convenient for handling of individual workpieces by a human operator.

As indicated above, Adams requires the operator to apply a force to turn the fabric edges in such a manner as to cause stretching at the sewn edges of the fabric, and the German reference teaches a method in which the tape element is fed underneath the folded edges of the continually fed length of fabric in an automatic feed method which may not be convenient for a human operator handling individual workpieces.

There is, therefore, a present need for a method which enables a human operator to handle a one-piece, seamless body portion of a garment to attach to folded edges thereof a sliding fastener type tape element conveniently, quickly, and without the application of undue handling forces to the edges of the fabric, while being able to observe the alignment, correspondence, and orientation of the fastener element being fed to a pair of cooperating sewing needles.

SUMMARY OF THE INVENTION

Accordingly, it is a principal object of this invention to provide a method for forming a seamless one-piece, body portion of a garment by attaching to two edges of the fabric an elongate fastener element without unduly stressing the edge portions of the fabric being sewn.

A related object of this invention is to provide a method by which a human operator can quickly and conveniently handle a patterned piece of fabric corresponding to a seamless body portion of a garment without stressing edge portions of the fabric, feed the edge portions of the fabric through folder elements beneath an elongate sliding fastener tape for sewing of the fastener tape to folded hems of the seamless body portion, with sleeves, foot coverings and other conventional elements being selectively attachable to the seamless body portion in conventional manner thereafter.

These and other related objects of this invention are realized by providing a method comprising the steps of:

cutting a piece of fabric to a pattern of a one-piece body portion of a garment, the piece of fabric having a head end, a lower end, elongate side edges, a face side, and a rear side, said fabric piece having a face side corresponding to the outer side of the garment;

positioning the piece of fabric with the face side thereof upward on a support surface beneath a base portion of a two-needle sewing machine, said base portion extending forwardly away from a user of the sewing machine and being mounted above the support surface, with the side edges disposed to be on opposite sides of the needles and the head end located upstream of the needles;

lifting the side edges of the piece of fabric upwardly around the forwardly extended base portion on opposite sides of the needles;

directing the side edges into a folder means for folding edge portions along the side edges and feeding the folded side edges forwardly along the extended base portion so that each folded edge passes a respective one of the two needles to be respectively hemmed thereby;

concurrently feeding an elongate fastener element to the needles above the folded edges forwardly and in correspondence with the folded edges being hemmed; and thereby sewing the fastener element to the folded sides of the piece of fabric while the folded edges are being hemmed, to provide an openable closure therebetween.

In another aspect of this invention, there is provided a method comprising the steps of:

cutting a piece of fabric to a pattern of a one-piece body portion of a garment, the piece of fabric having a head end, a lower end, elongate side edges, a face side, and a rear side, wherein said lower end extends to include two leg portions, said fabric piece having a face side corresponding to the outer side of the garment;

positioning the piece of fabric with the face side thereof upward on a support surface beneath a base portion of a two-needle sewing machine, said base portion extending forwardly away from a user of the sewing machine and being mounted above the support surface, with the side edges disposed to be on opposite sides of the needles and the head end located upstream of the needles;

lifting the side edges upwardly around the forwardly extended base portion on opposite sides of the needles;

directing the side edges of the piece of fabric into a folder means for folding edge portions along the side edges and feeding the folded side edges forwardly along the extended base portion so that each folded edge passes a respective one of the two needles to be respectively hemmed thereby;

concurrently feeding an elongate fastener element to the needles above the folded edges forwardly and in correspondence with the folded edges being hemmed; and thereby sewing the fastener element to the folded sides of the piece of fabric while the folded edges are being hemmed, to provide an openable closure therebetween, said closure extending lengthwise through the body portion and one of the two leg portions.

BRIEF DESCRIPTION OF THE DRAWING

FIG. 2, are omitted from FIG. 4.

DETAILED DESCRIPTION OF THE PREFERRED EMBODIMENTS

Figure 1:
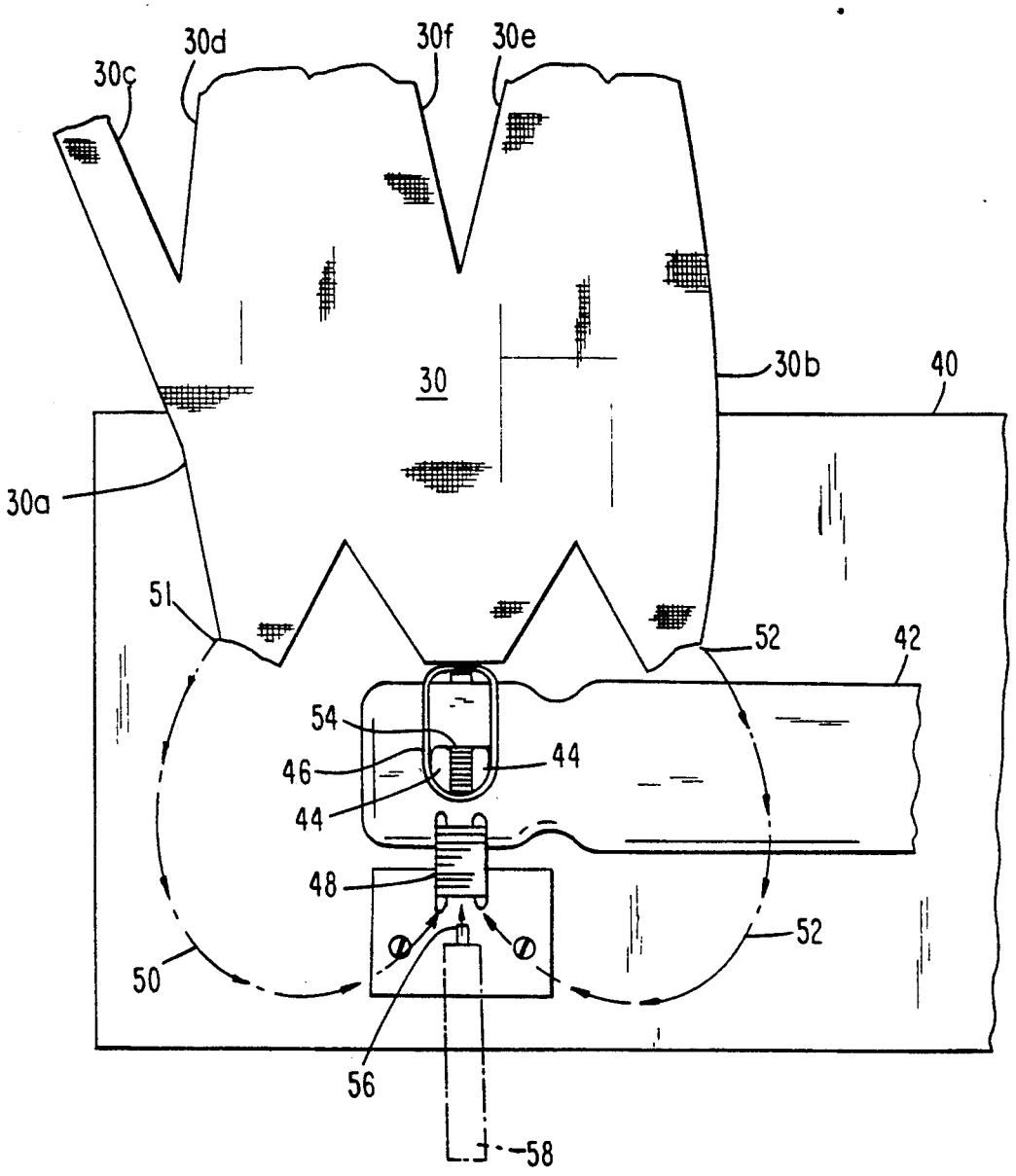
Figure 1 (PRIOR ART)
FIG. 1 illustrates aspects of a known method for attaching a sliding fastener tape to edges of a piece of fabric for forming a seamless body portion of a garment with a double-needle sewing machine.

As mentioned earlier, U.S. Pat. No. 4,956,879, to Adams, teaches one method for making a seamless one-piece body portion of a garment. Referring to FIG. 1 of the present application (FIG. 6 of the Adams reference) there is seen a piece of fabric 30 precut to a desired pattern for making the garment, the pattern including leg portions and elongate sides 30*a* and 30*b* to which are to be attached opposite sides of an elongate sliding fastener element. The workpiece 30 is laid "face down" on a platform of the sewing machine with the head end of the workpiece closest to the operator (who may be visualized as sitting towards the lower end of the drawing of FIG. 1). Elongate side edges 30*a* and 30*b* are placed to be on opposite sides of needles 44 and the outermost nearest corners 51 and 52 of the workpiece are then drawn over as indicated by broken-arrow lines 50 and 52 to be fed into folding means 48, the portions of the fabric at corners 51 and 52 being turned over in the process.

Figure 2:
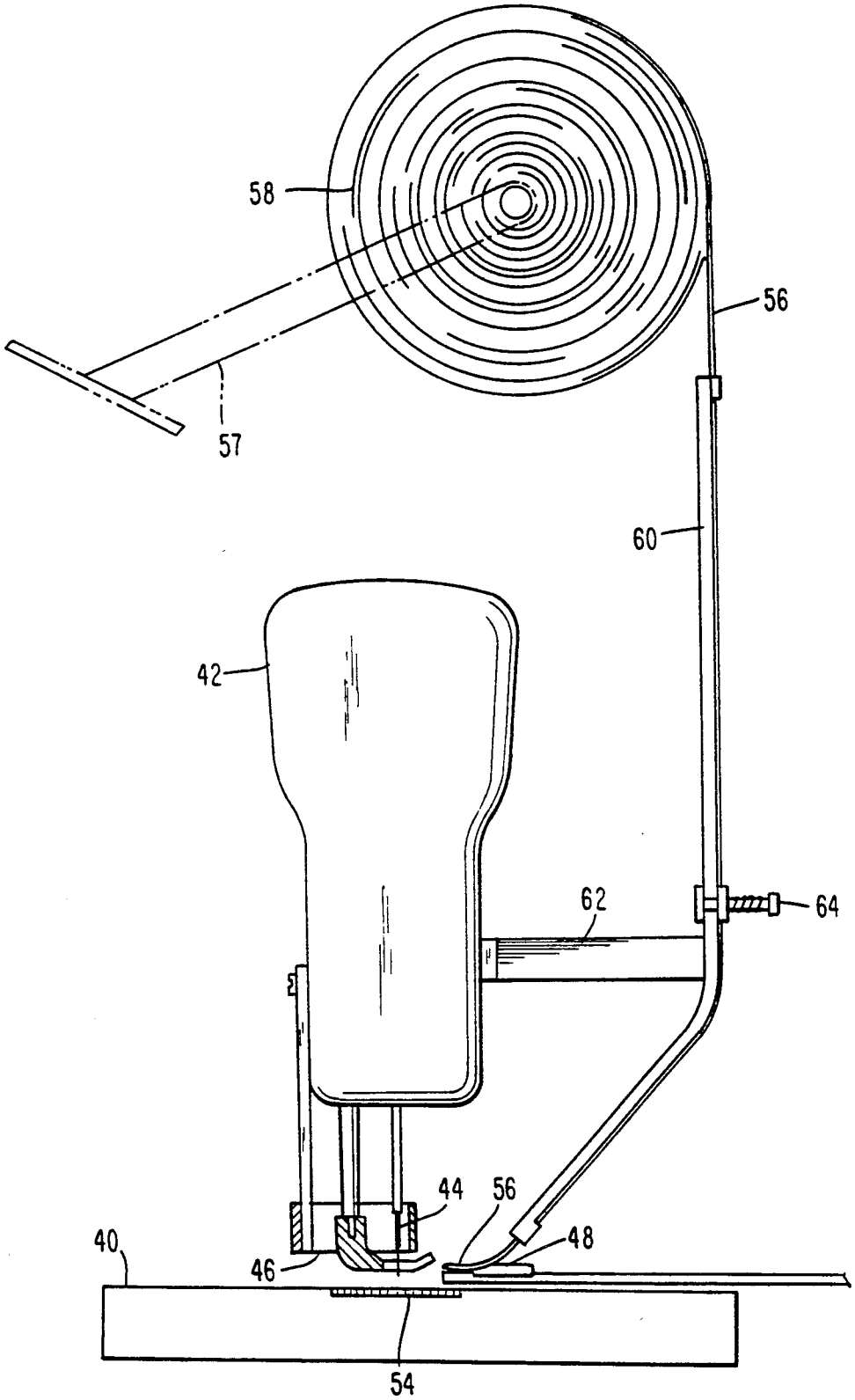
Figure 2 (PRIOR ART)
FIG. 2 illustrates structure for feeding a length of sliding fastener tape over folded edges of a piece of fabric in the method illustrated in FIG. 1.
Figure 3:
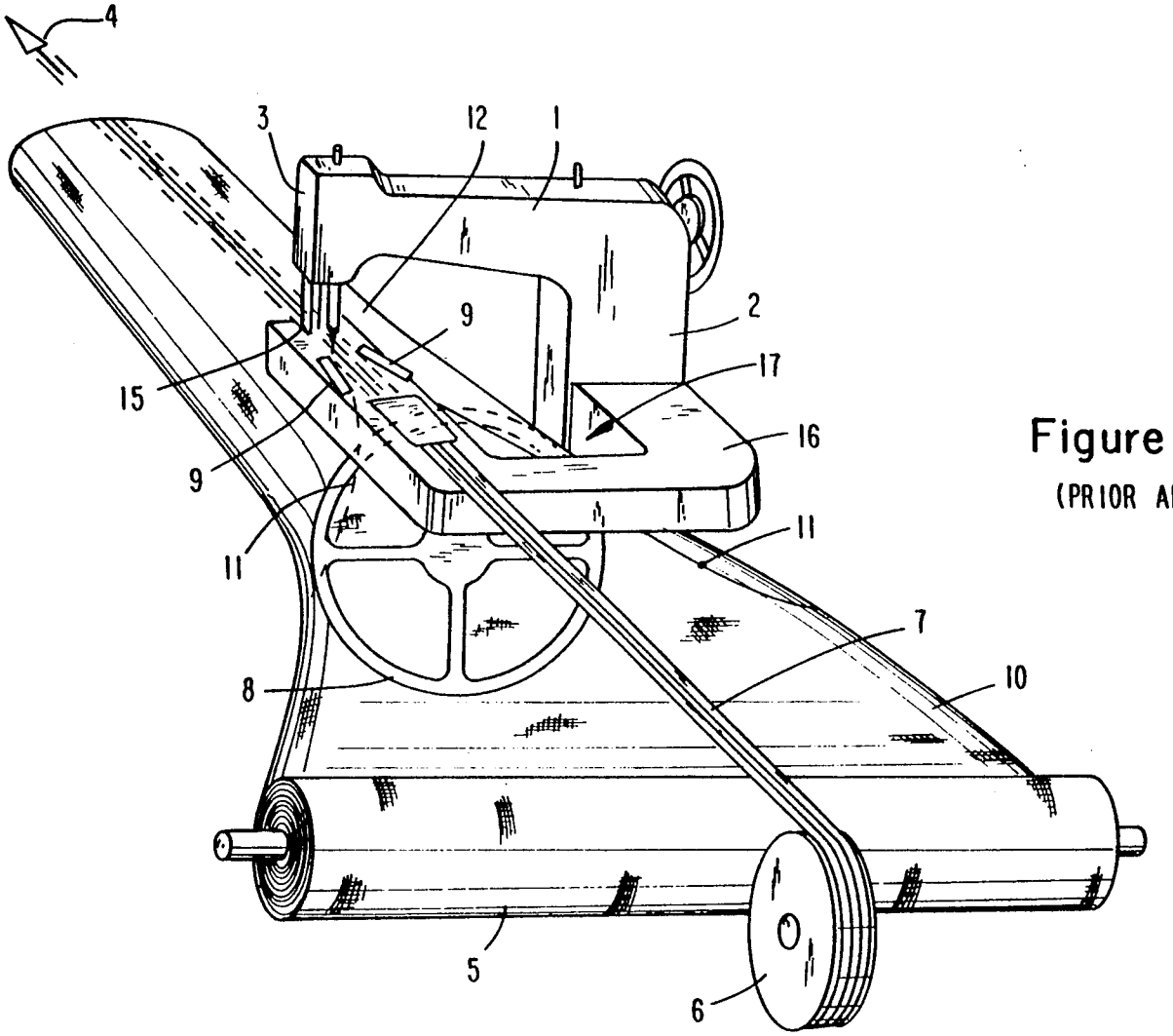
Figure 3 (PRIOR ART)
FIG. 3 illustrates aspects of a method for feeding folded edges of a long length of fabric from a bolt, over an elongate sliding fastener tape, to a double-needle sewing machine.

Referring now to FIG. 2, there is seen a known structure per the above-referenced Adams patent for providing a length of an elongate sliding fastener type tape 56 along guide 60, under a tension controlled by tension element 64, over a front end of folding means 48 above fabric element 30 to the pair of cooperating needles 44. In FIG. 2, as indicated by phantom lines, a support 57 rotatably supports a reel 58 of the tape 56. Likewise, a support arm 62 mounted to the sewing machine head 42 conveniently provides support for guide 60, tension adjustment means 64, and the distal portion of the guide leading tape 56 to a point above holding means 48. The known structure of FIG. 2 is entirely usable with the principal elements of the apparatus of this invention according to which the claimed method may be practiced. Accordingly, U.S. Pat. No. 4,956,879, to Adams, is expressly incorporated herein by reference for its teaching of such exemplary structure for supporting and providing sliding fastener type tape to folded elongate side edges of a workpiece to be sewn by a pair of cooperating needles.

Figure 4:
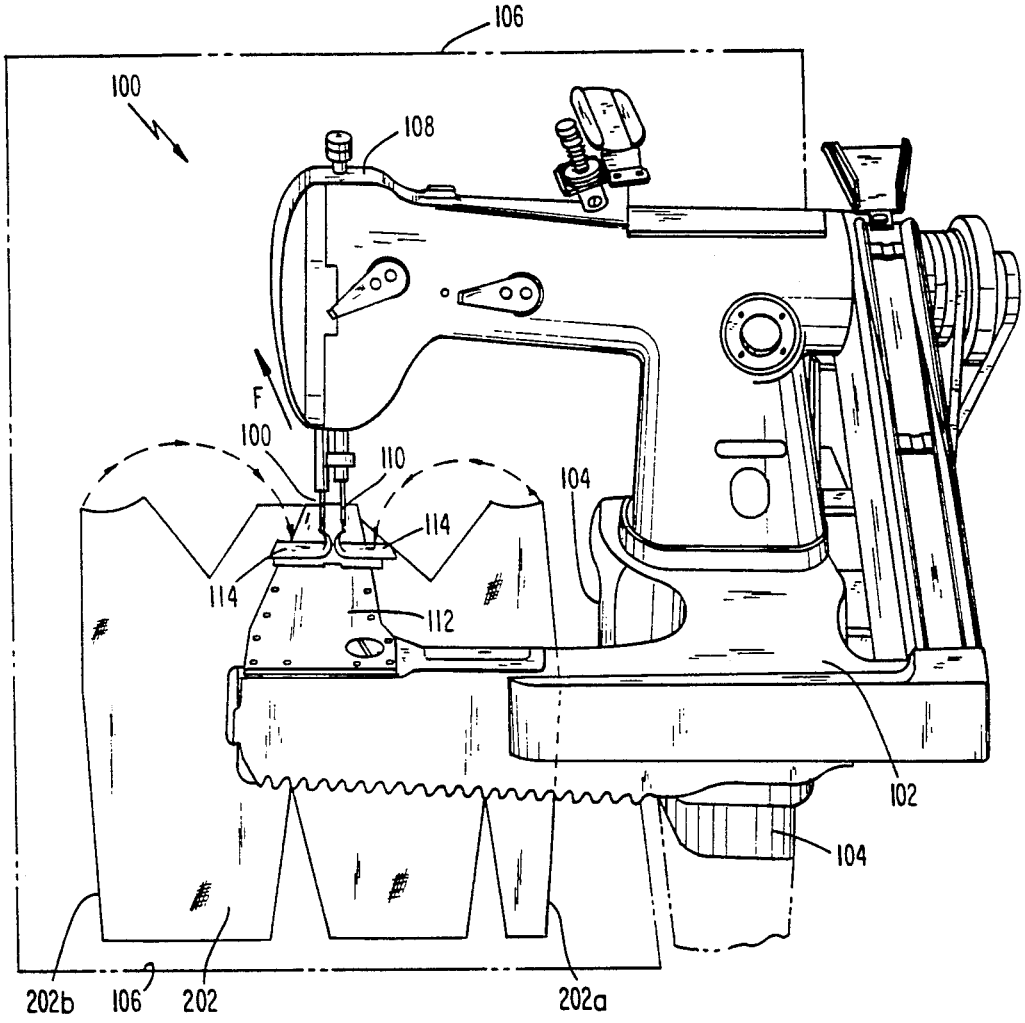
FIG. 4 is a perspective view of an exemplary double-needle sewing machine, such as a Singer (261), with a piece of fabric patterned to form a seamless one-piece, body portion of a garment, to illustrate the manner in which the fabric is fed through needles of the sewing machine according to a preferred embodiment of this invention. For simplicity, elements for providing a length of sliding fastener tape in known manner, e.g., per

FIG. 4 illustrates the manner in which the method according to a preferred embodiment of this invention may be practiced with an exemplary sewing machine of the type illustrated therein, e.g., a Singer, Model 261, which is currently commercially available. The sewing machine 100 has a base 102 mounted on support legs 104, 104 above a support surface 106 indicated generally in phantom lines, at a convenient predetermined height thereabove, e.g., a few inches. Base 102 supports sewing head 108 from which depend a pair of parallel vertically reciprocating sewing needles 110, 110 which operate above a forward end of a lateral extension 112 of base 102. In effect, therefore, there is a few inches of space beneath the bottom of extension 112 for a workpiece such as 202 resting on a generally horizontal support surface 106. There is enough room thus provided for an operator to be able to extend his or her arms beneath extension 112 of base 102 to handle workpiece 202 in a manner to be described more fully hereinbelow.

Figure 6:
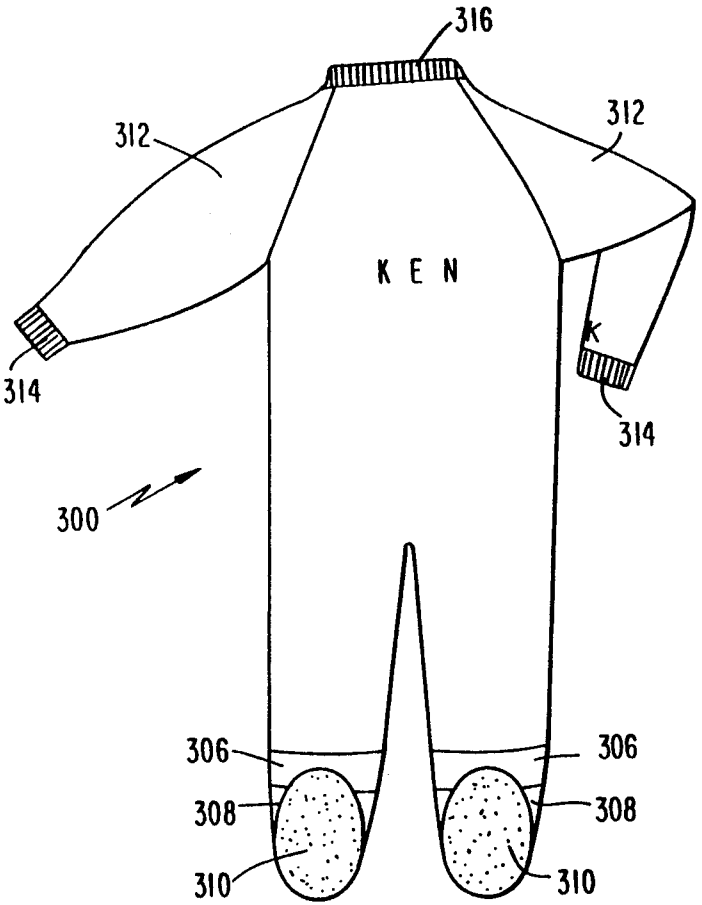
FIGS. 5 and 6 are front and back views, respectively, of an exemplary child's garment having a seamless body portion with a sliding fastener extending from the neck to the crotch, formed according to the preferred method of this invention.
Figure 5:
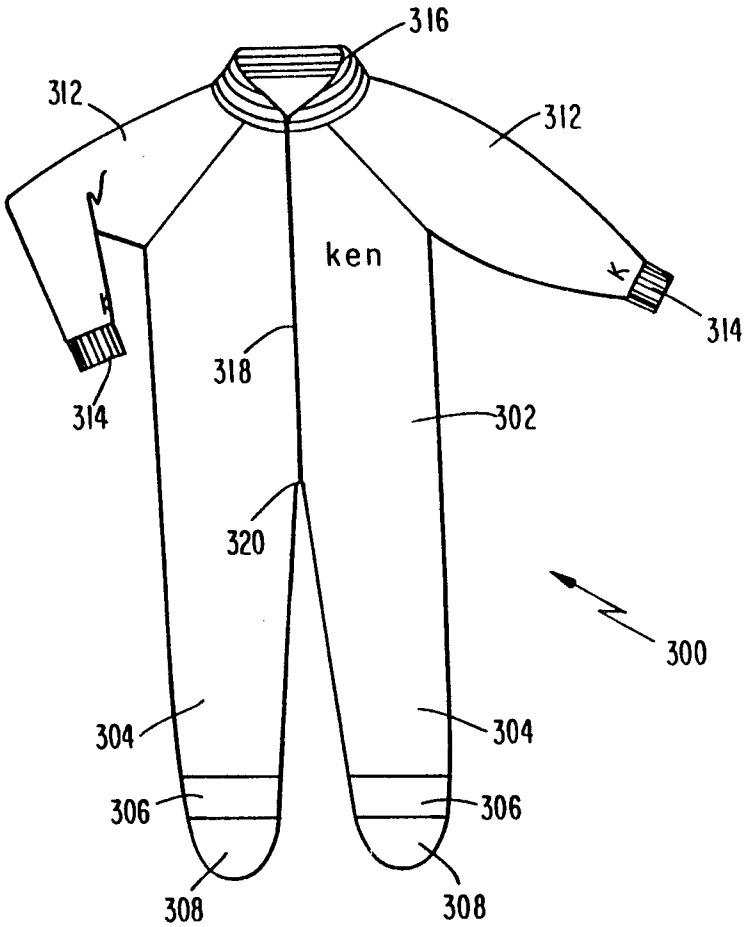
Figure 14:
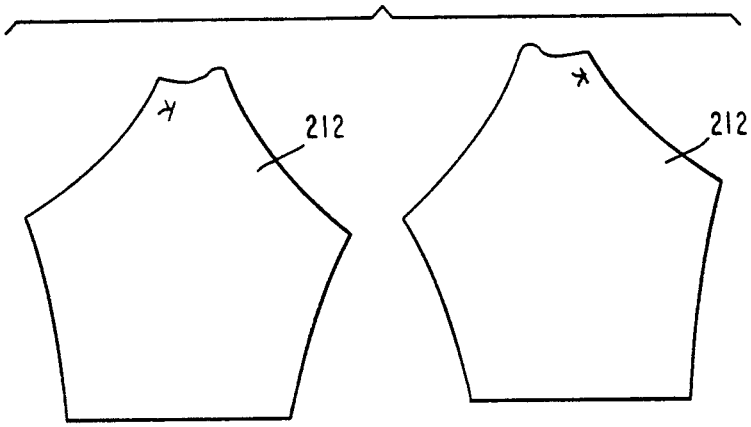
FIGS. 14–17 illustrate, respectively pattern shapes for a pair of sleeve elements, a seamless body portion including leg portions, a pair of foot portions, and a pair of toe portions of a garment according to FIG. 7.
Figure 15:
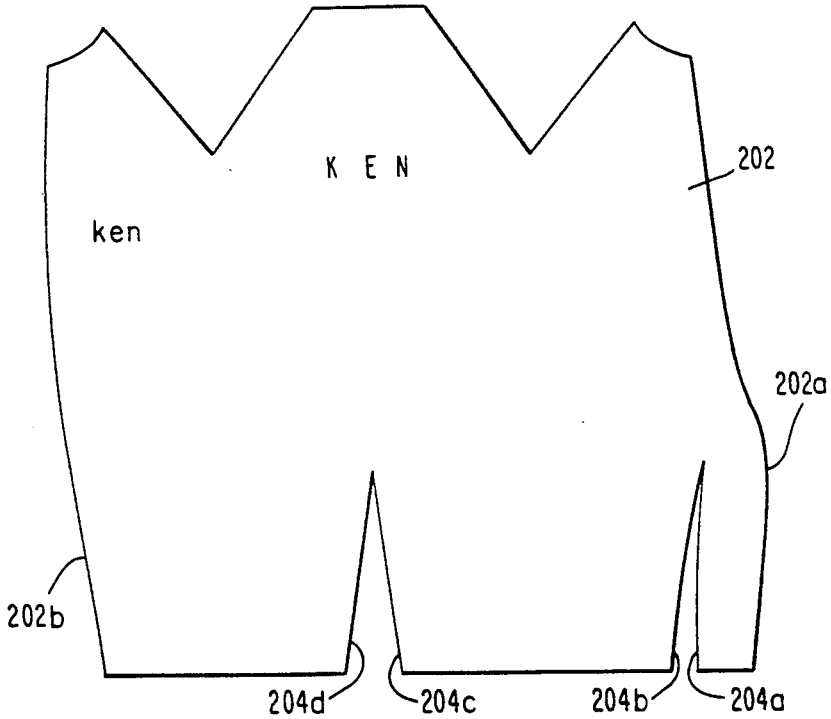
Figure 16:
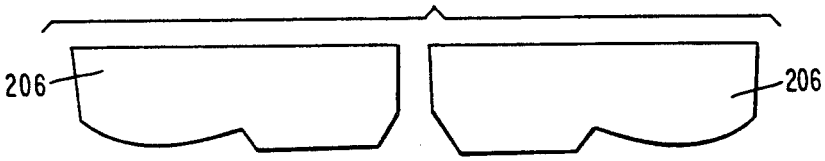
Figure 17:
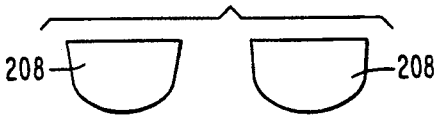

Referring briefly to FIGS. 5 and 6, there is seen in front and rear views, respectively, a typical child's garment having a one-piece, seamless body portion, arms, leg portions and optional cuffs at the collar and sleeves. The finished garment may have, in suitably decorative manner, the wearer's name embroidered on its outer side on the front and/or back, as well as initials on the sleeves. There is a secondary purpose in thus illustrating an exemplary wearer's name "KEN" on the garment illustrated in FIGS. 5 and 6. This purpose is to clarify, with reference to other figures, how a workpiece according to the claimed method is placed "face up", i.e., with the wearer's initials which are to be visible on the outside of the garment being considered as being provided on the face of the initial fabric elements. Then, as best understood with reference to FIGS. 13, 14 and 15, the "back" or "rear surface" of the fabric elements is illustrated by showing the exemplary wearer's name "KEN" in dotted manner and reversed. It is believed that this explanation should suffice for persons of ordinary skill in the art to appreciate the manner in which the workpiece is initially positioned beneath sewing machine 100, handled, assembled with other parts, and utilized to form the finished product.

FIGS. 5 and 6 illustrate a finished product, i.e., a child's sleep-suit 300 which is formed from a seamless one-piece body portion 302 which has leg covering portions 304, 304 to which may be attached ankle portions 306, 306 and which may end in foot portions or booties 308, 308. As best seen in FIG. 6, booties 308, 308 may be provided with non-slip soles 310, 310 formed of a material, e.g., latex-covered fabric, which has a relatively high coefficient of friction. In the alternative, the material of soles 310, 310 could be somewhat thicker, fleece-type, warmth-retaining material, e.g., a one or multi-layer sole made of felt. These are optional details.

At the upper end of garment 300, attached in any conventional manner to the head end of the seamless one-piece body portion 302 are sleeves 312, 312 which can be provided at their distal ends with elasticized sleeve cuffs 314, 314. The neck end of garment 300 may be provided with a collar or neck cuff 316, as generally indicated in FIGS. 5 and 6. Exemplary garment 300 has a sliding fastener type closure 318 which extends from the head end of the seamless, one-piece body portion 302, i.e., from collar 316, to the crotch portion 320 of the garment. Minute details of the sliding fastener 318 are not illustrated because they are not essential to an understanding of the claimed method.

As will be readily appreciated, different materials, different colors, different textures, different degrees of thermal protection and the like can be readily incorporated into a garment such as garment 300. Therefore, additional details of such aspects of the final product produced by the claimed method are not provided.

Figure 7:
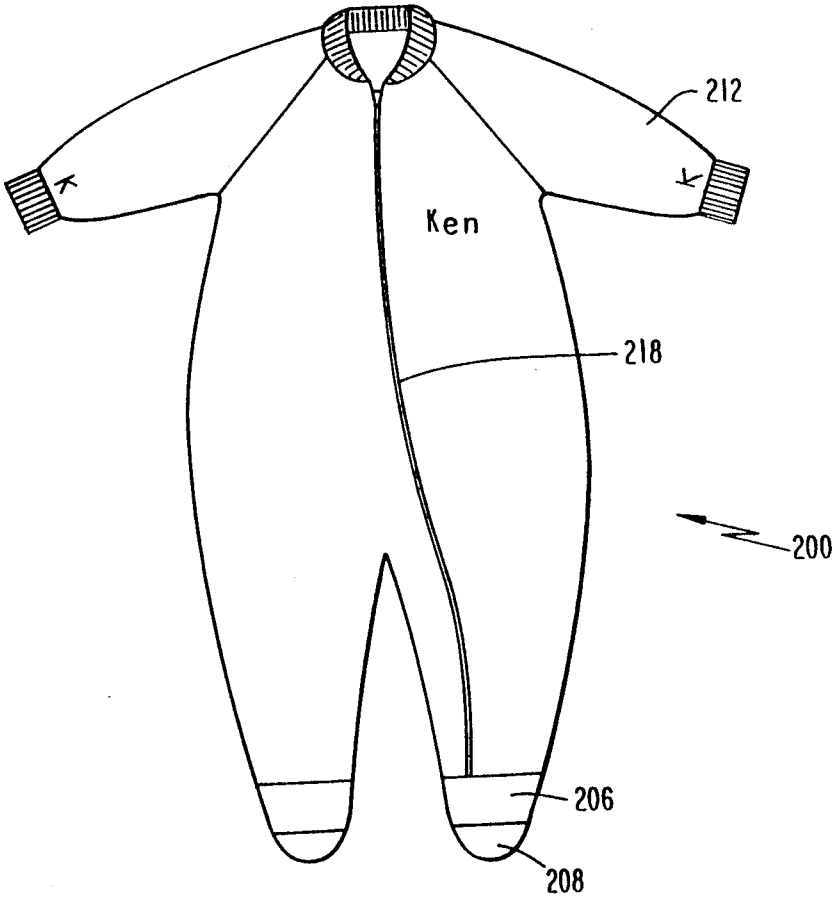

FIGS. 6 and 7 illustrate a somewhat different end product, i.e., a child's garment 200 which differs from the above-described garment 300 only in that the sliding fastener closure is longer and extends from the neck portion of the finished garment to the ankle end of one of the two leg portions. This type of garment may be more suitable for babies and very young children who may be too young to cooperate with the parent or caretaker putting them into or taking them out of the garment. In other words, since the garment can be opened virtually from the top to the bottom, it may be easier to put on to or take off from the body of a very young child. Other details of the finished product as illustrated in FIGS. 6 and 7 being essentially the same as those described in greater detail for garment 300 illustrated in FIGS. 5 and 6, additional description of garment 400 is not believed to be necessary.

Figure 9:
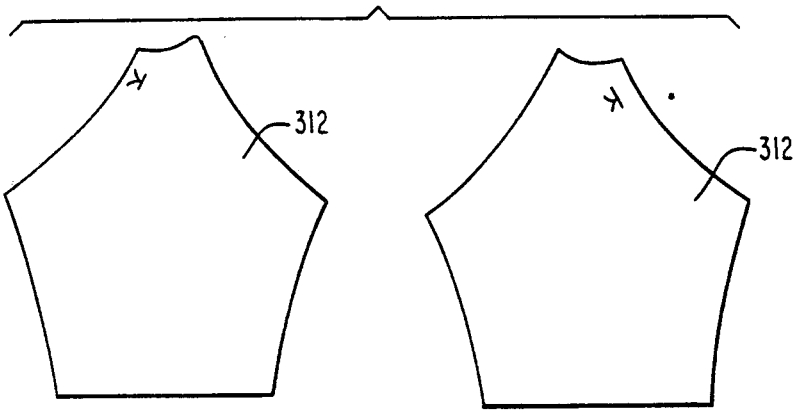
FIGS. 9–12 illustrate, respectively, pattern shapes for a pair of sleeve elements, a seamless body portion including leg portions, a pair of foot portions, and a pair of toe portions of a garment according to FIG. 5.
Figure 10:
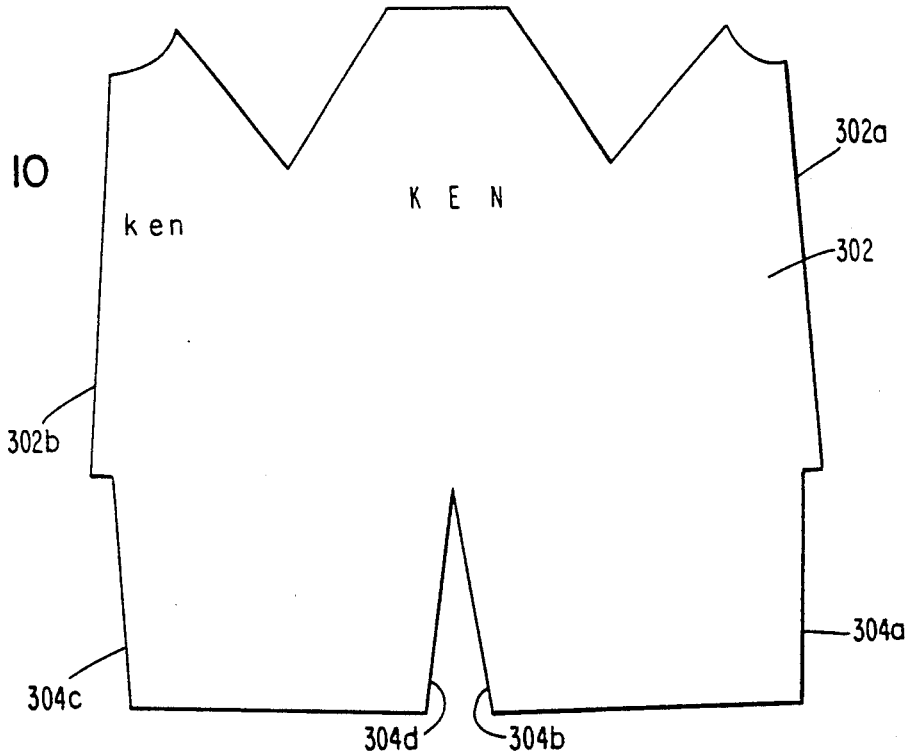
Figure 11:
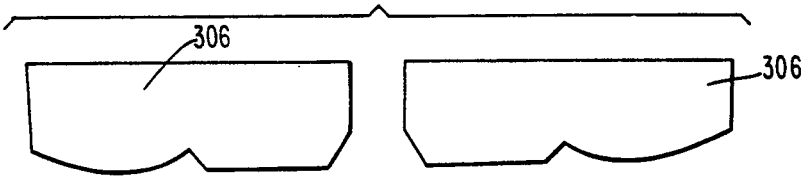
Figure 12:
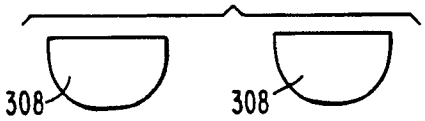

FIG. 9 shows matching sleeve patterns 312, 312; FIG. 10 the main one-piece body portion 302; FIG. 11 matching ankle portions 306, 306; and FIG. 12 foot or bootie portions 308, 308, for the embodiment illustrated in assembled form in FIG. 5. As is readily seen from FIGS. 9 and 10, decorative markings may readily be applied to the individual elements of the finished garment prior to assembly, and may include embroidered or painted-on letters, symbols, emblems or the like. Similar markings may be provided to the main body portion 302 as well. Furthermore, the decorative aspect of the garment can include the provision of different colors, textures, materials, or finish for the different components which are to be assembled together. Thus, for example, the sleeves 312, 312 and the main body portion 302 may be made of the same material except for color, and ankle portions 306 may be made of a different material, e.g., a water-impermeable material. Similarly, the toe or foot portions 308, 308, and possibly soles 310, 310 (see FIG. 6), may be made of yet other colors and/or materials to prevent slippage on a polished floor, or to keep out moisture in case the child steps into spilled liquids. These are minor, conventional and well-known details of garment manufacturing which can be readily incorporated with the improved method for attaching a sliding fastener type tape element to the main body portion 302.

Figure 8:
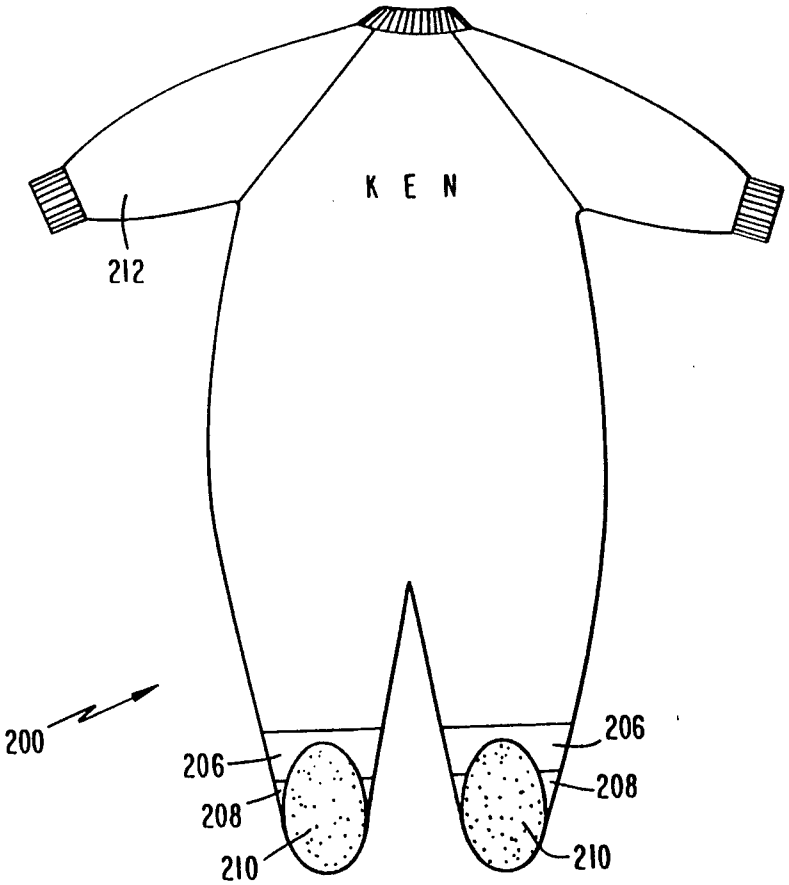
FIGS. 7 and 8 are front and back views, respectively, of a modified form of the garment illustrated in FIGS. 5 and 6, wherein the elongate sliding fastener closure element extends from the neck to about the ankle portions of a seamless body portion type of garment particularly suitable for a baby or a very young child.

Referring now to FIGS. 14–17, the parallel with the elements of FIGS. 9–12 will be readily apparent. The only significant difference between these two sets of figures is that the side edges 302*a* and 302*b* of main body portion 302 are shorter than comparable side edges 202*a* and 202*b* of the one-piece main body portion 202 for the garment illustrated in front and back views, respectively, in FIGS. 7 and 8. Consequently, the sliding fastener element 318 of the garment 300 per FIG. 5 will extend only from the neck of the garment to the crotch 320 thereof, whereas in the garment 200, per FIGS. 7 and 8, the sliding fastener element attached to edges 202*a* and 202*b* will extend from the neck to the ankle portion of one of the legs of the finished garment. Other than this difference, the other method steps are essentially the same for producing either type of garment.

Referring again to FIG. 4, the operator places the exemplary one-piece central body portion 202 underneath extended arm 112 of the sewing machine and without stretching, stressing or in any way distressing the fabric, simply lifts the forwardmost ends of side edges 202*a* and 202*b* upwardly on either side of extension 112 of the sewing machine, as indicated by the sequence of short arrows, so that the rear surface of the fabric is now uppermost. The edges are then fed forwardly, i.e., in the direction of arrow "F" towards the needles and away from the operator's position through a conventional set of folder elements 114, 114 to fold edges 202*a* and 202*b* before the edges are advanced to pass under cooperating needles 110, 110.

As best seen by reference to FIGS. 1 and 2 sliding fastener tape 56 can be provided in known manner from a reel 58 conveniently mounted to the sewing machine head. This is part of the known prior art, and is adapted in obvious manner to use with the sewing machine 100 of the type illustrated in FIG. 4. Reel 58 and a length of the sliding fastener tape 56 are not illustrated in FIG. 4 to avoid confusing the same with too much detail. Persons of ordinary skill in the mechanical arts, however, should readily appreciate that reel 58 can be supported above sewing machine head 108, that a tension control element 64 can be mounted on an arm 62 supported to sewing machine head 108, and selected lengths of the sliding fastener tape fed by the operator above the folded edges 202*a* and 202*b* toward needles 110, 110.

The key difference between the subject matter illustrated in FIGS. 1 and 4 is the manner in which the fabric element is handled in the method of Adams and in the present invention, respectively, immediately prior to being fed into the respective folding elements illustrated therein.

Figure 13:
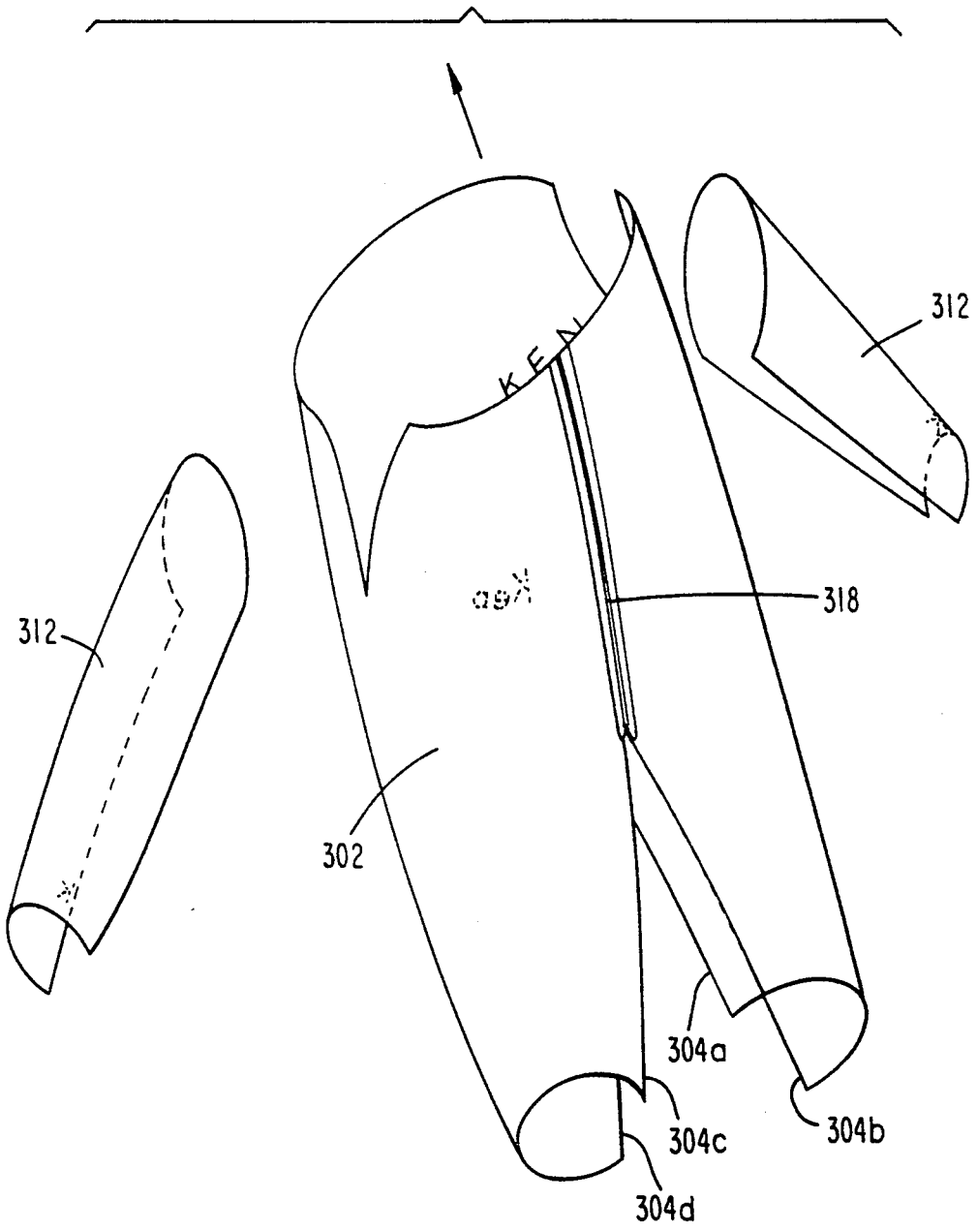
FIG. 13 is a partially assembled view of a garment according to FIG. 5, to illustrate the manner in which the sleeve elements may be attached to the seamless body portion.
Figure 18:
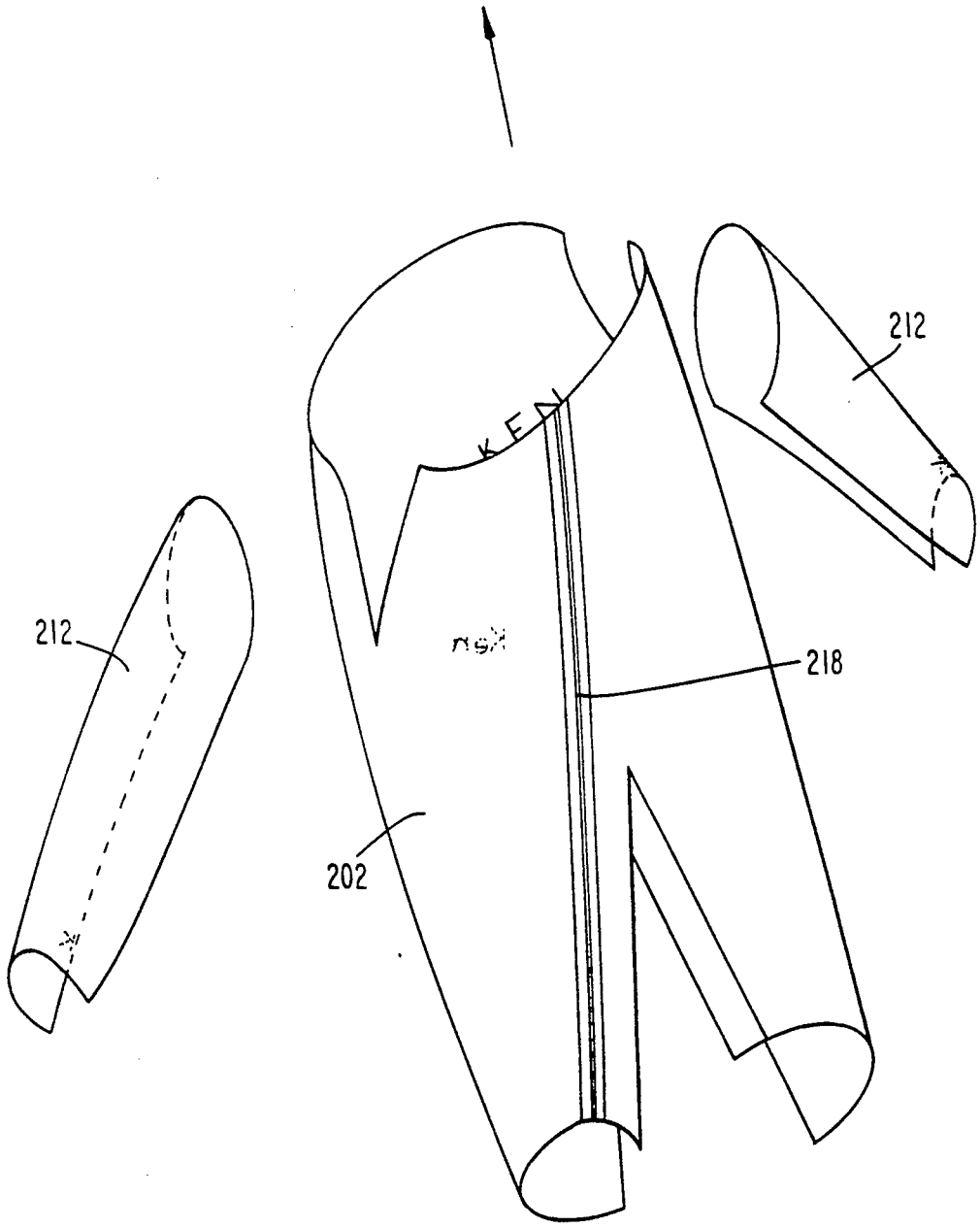
FIG. 18 is a partially assembled view of a garment according to FIG. 7, to illustrate the manner in which the sleeve elements may be attached to the seamless body portion.

FIGS. 13 and 18 respectively illustrate a state in the garment manufacturing process at which the sliding fastener elements 318 or 218 have been affixed to the corresponding main body portions 302 or 202. At this stage, the main body portion for either embodiment is inside out or everted. As readily seen in FIGS. 13 and 18, the respective sleeve elements 312, 312 or 212, 212 for the different embodiments may be provided in similarly everted form and sewn to the main body portion in conventional manner. Likewise, seams to complete the leg portions can be formed in conventional manner with the garment still in an everted state. Other similar steps can be provided in conventional manner to attach a collar, sleeve cuffs, ankle portions, and the like. Such details, being well understood, need not be described further.

In the above description, the term "seamless" is intended to convey only that the finished garments have a one-piece body portion made of a single piece of fabric with no seams directly holding edges of the body portion together. It is understood that conventional seams may be formed to apply a collar, cuffs, ankle portions or the like, as well as to complete joinder of the leg portion edges 304*a* to 304*b* and 304*c* to 304*d* in the embodiment per FIG. 5. Similarly, comparable joinders would be made of edges 204*a* to 204*b* and 204*c* to 204*d* in the embodiment of FIG. 7.

As noted earlier, it is important that the folded edges of the material approach needles 110, 110 in correspondence with the edges of the sliding fastener tape laid thereover. If the two folded edges and the sliding fastener tape do not all move together and evenly, wrinkles and other imperfections may arise which could lead to rejections by the manufacturer's quality control personnel and would represent an inefficiency and monetary loss.

The method of this invention is believed to be particularly comfortable and non-stressful for operators of the sewing machine since it involves only the lifting up of opposite side edges from opposite sides of extension 112 of the sewing machine base, without the need to turn the fabric feeding direction. Furthermore, since the sliding fastener element is being applied over the top of the folded edges, and since such a tape typically is of the order of ½" to ¾" wide, the operator can use the outer edges of the sliding fastener tape as a guide in simultaneously feeding the tape and the underlying folded edges of the fabric accurately and rapidly to the cooperating needles 110, 110. While the actual savings in operational time may be only a few seconds per garment because of this ease of handling, when this is combined with the ease of movements involved and the lack of stress imposed on the operator performing such a task repetitiously, there should be significant benefits in terms of overall quality and reduced rejection rates experienced by the manufacturer. The method is in no way restrictive in terms of the size of the garment produced or on whether the material is knitted or woven. Because of the very easy step of lifting the opposite side edges where there is ample room for the operator's arms and hands, even relatively heavy, slick, or otherwise difficult to handle materials can be readily manipulated into position to have the edges folded over for simultaneous stitching of the hem and the sliding fastener element to the one-piece seamless body portion of the garment.

Although the above discussion has focused principally on forming a garment with a seamless body portion of a garment, the method inherently has wider utility. Thus, for example, a heavy and relatively complex fabric structure like a down-filled sleeping bag or even a tent could be readily supported beneath a sewing machine and only the necessary edges thereof would need to be lifted and fed by the operator to the needles, as described, in conjunction with a length of the elongate fastener element. Furthermore, the "zipper" type of sliding fastener is only one example of such an element, and other alternatives can be sewn to a workpiece, according to the method of the present invention, to create the intended closure.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A method of making a garment including a seamless body portion that has an outer side and an inner side, comprising the steps of:

cutting a piece of fabric to a pattern of a one-piece body portion of a garment, the piece of fabric having a head end, a lower end, elongate side edges, a face side, and a rear side, said fabric piece having a face side corresponding to the outer side of the garment;

positioning the piece of fabric with the face side thereof upward on a support surface beneath a base portion of a two-needle sewing machine, said base portion extending forwardly away from a user of the sewing machine and being mounted above the support surface, with the side edges disposed to be on opposite sides of the needles and the head end located upstream of the needles;

lifting the side edges of the piece of fabric upwardly around the forwardly extended base portion on opposite sides of the needles;

directing the side edges into a folder means for folding edge portions along the side edges and feeding the folded side edges forwardly along the extended base portion so that each folded edge passes a respective one of the two needles to be respectively hemmed thereby;

concurrently feeding an elongate fastener element to the needles above the folded edges forwardly and in correspondence with the folded edges being hemmed; and sewing the fastener element to the folded sides of the piece of fabric while the folded edges are being hemmed, to provide an openable closure therebetween.

2. The method according to claim 1, comprising the further step of;

attaching sleeves adjacent the head end of the body portion.

3. The method according to claim 2, comprising the further steps of:

attaching sleeve cuffs at respective distal ends of the sleeves.

4. A method of making a garment including a seamless body portion that has an outer side and an inner side, comprising the steps of:

cutting a piece of fabric to a pattern of a one-piece body portion of a garment, the piece of fabric having ahead end, a lower end, elongate side edges, a face side, and a rear side, wherein said lower end extends to include two leg portions, said fabric piece having a face side corresponding to the outer side of the garment;

positioning the piece of fabric with the face side thereof upward on a support surface beneath a base portion of a two-needle sewing machine, said base portion extending forwardly away from a user of the sewing machine and being mounted above the support surface, with the side edges disposed to be on opposite sides of the needles and the head end located upstream of the needles;

lifting the side edges upwardly around the forwardly extended base portion on opposite sides of the needles;

directing the side edges of the piece of fabric into a folder means for folding edge portions along the side edges and feeding the folded side edges forwardly along the extended base portion so that each folded edge passes a respective one of the two needles to be respectively hemmed thereby;

concurrently feeding an elongate fastener element to the needles above the folded edges forwardly and in correspondence with the folded edges being hemmed; and sewing the fastener element to the folded sides of the piece of fabric while the folded edges are being hemmed, to provide an openable closure therebetween, said closure extending lengthwise through the body portion and one of the two leg portions.

5. The method according to claim 4, comprising the further step of:

attaching sleeves adjacent the head end of the sleeveless body portion.

6. The method according to claim 5, comprising the further step of:

attaching sleeve cuffs at respective distal ends of the sleeves.

7. The method according to claim 5, comprising the further step of:

completing the garment by sewing the sides of each leg portion together; and attaching ankle portions at distal ends of the respective sewn leg portions.

8. The method according to claim 7, comprising the further step of:

attaching foot portions to distal end portions of the respective ankle portions.

9. The method according to claim 8, wherein:

the step of attaching the foot portions comprises attaching booties.

10. An improved method for attaching an elongate fastener element to two edges of a fabric workpiece, comprising the steps of:

positioning the workpiece beneath a portion of a base of a sewing machine, said base portion being located in front of and extending forwardly of an operator, with the two edges disposed on opposite sides of the extended portion of the base; and lifting forwardmost ends of the two edges and feeding them forwardly away from the operator along the extended base portion through an edge folder element to a pair of cooperating needles of the sewing machine while simultaneously feeding the elongate fastener element forwardly and overlying the folded edges at a corresponding rate, whereby parallel edge portions of the elongate fastener element are sewn to the two folded edges.

* * * * *